US006971291B2

(12) United States Patent
An

(10) Patent No.: US 6,971,291 B2
(45) Date of Patent: Dec. 6, 2005

(54) CONNECTING COMPENSATING DEVICE OF MULTIANGULAR WRENCH SOCKET

(76) Inventor: Tsai An, No. 27, Hsiang Shyue Road, Ta Li,Taichung Hsien (TW)

( * ) Notice: Subject to any disclaimer, the term of this patent is extended or adjusted under 35 U.S.C. 154(b) by 138 days.

(21) Appl. No.: 10/737,847

(22) Filed: Dec. 18, 2003

(65) Prior Publication Data

US 2005/0011318 A1 Jan. 20, 2005

(30) Foreign Application Priority Data

Jul. 16, 2003 (TW) ..... 92213039 U

(51) Int. Cl.[7] ..... B25B 17/00; B25G 1/08; B25G 3/02

(52) U.S. Cl. ..... 81/177.2; 81/177.4; 81/438

(58) Field of Search ..... 81/177.2, 177.4, 81/436, 438, 439, 490

(56) References Cited

U.S. PATENT DOCUMENTS 1,635,649 A * 7/1927 Tillmanns ..... 30/429
1,806,441 A * 5/1931 Bauer et al. ..... 294/99.2
2,111,195 A * 3/1938 Skau ..... 7/126
2,376,135 A * 5/1945 Frasher ..... 294/99.2
2,457,037 A * 12/1948 Fadeley, Jr. ..... 7/110
2,779,098 A * 1/1957 Pocoski et al. ..... 30/155
2,904,373 A * 9/1959 Dowdy et al. ..... 403/316
3,056,200 A * 10/1962 Williams ..... 30/148
3,406,450 A * 10/1968 Grotz ..... 30/279.6
3,669,133 A * 6/1972 Hyman ..... 135/74
4,023,271 A * 5/1977 Di Franco ..... 30/123
4,231,128 A * 11/1980 James ..... 7/112
4,823,419 A * 4/1989 Stimpson ..... 7/113
5,735,005 A * 4/1998 Wang ..... 7/127
5,829,965 A * 11/1998 Rubalcava ..... 431/253
5,911,799 A * 6/1999 Johnson et al. ..... 81/177.4
5,950,504 A * 9/1999 Italia ..... 81/3.09
5,996,169 A * 12/1999 Cooper ..... 15/257.01
6,014,785 A * 1/2000 Punch et al. ..... 7/105
D433,915 S * 11/2000 Elsener, Sr. ..... D8/105
6,142,769 A * 11/2000 Walker ..... 431/253
6,209,425 B1 * 4/2001 Hu ..... 81/177.2
6,598,503 B1 * 7/2003 Cunningham ..... 81/177.4

* cited by examiner

*Primary Examiner*—Joseph J. Hail, III
*Assistant Examiner*—Robert Scruggs
(74) *Attorney, Agent, or Firm*—Troxell Law Office, PLLC

(57) ABSTRACT

A connection compensating device of multiangular wrench socket, including a main body and a connecting section. The main body is a cylindrical body. The outer circumference of the main body between two ends thereof is formed with several radially arranged flutes which extend along a circular axis by a certain length. The flutes have different cross-sectional areas. The connecting section includes a first tubular body fitted around the main body. The first tubular body is rotatable about the circular axis of the main body. The first tubular body is partially overlaid on the flutes. The geometric central axis of the profile of inner circumference of the first tubular body does not coincide with the circular axis of the main body. A user can selectively insert an L-shaped multiangular wrench into one of the flutes and the first tubular body. By means of rotating the first tubular body, the inner circumference of the first tubular body can tightly abut against the multiangular wrench for the user to more reliably and conveniently operate the wrench.

16 Claims, 5 Drawing Sheets

CONNECTING COMPENSATING DEVICE OF MULTIANGULAR WRENCH SOCKET

BACKGROUND OF THE INVENTION

The present invention is related to a hand tool, and more particularly to a connection compensating device of L-shaped multiangular wrench socket.

A conventional L-shaped multiangular wrench generally has a hexagonal cross-section. One end of the hexagonal wrench is inserted in a hexagonal dent of a screw. A user can turn the other end of the hexagonal wrench to screw/unscrew the screw. Due to limitation of space, in some cases, a user can hardly operate the hexagonal wrench to wrench the screw. As a result, the wrench often slips out of the dent of the screw.

FIG. 7 shows a socket structure for connecting with the L-shaped hexagonal wrench. The socket structure serves as a handle and is applicable to various sizes of hexagonal wrenches. The socket structure facilitates the operation of the hexagonal wrench. The socket structure has a cylindrical body 91. The outer circumference of the cylindrical body 91 is formed with several radially arranged flutes 92 which extend along the axis of the cylindrical body 91. The flutes 92 are partially blocked to form a receptacle 921. A user can insert a short bar section of an L-shaped hexagonal wrench into a suitable flute 92 and receptacle 921. Under such circumstance, the cylindrical body 91 serves as a handle to facilitate operation of the wrench.

The above structure can be readily used as the handle of the hexagonal wrench. In design, the space of the flutes 92 should be slightly larger than the corresponding wrench, whereby the wrench can be more easily inserted into the flute 92. This makes the wrench and the cylindrical body 91 tend to swing and slip after assembled. Therefore, it is inconvenient to operate the wrench. On the other hand, there are metric and British system hand tools. Therefore, in the case that the socket structure is compatible with metric system wrench, the socket structure will be incompatible with the British system wrench. This also leads to inconvenience in use.

SUMMARY OF THE INVENTION

It is therefore a primary object of the present invention to provide a connection compensating device of multiangular wrench socket, which can be firmly connected with the multiangular wrench and conveniently operated.

It is a further object of the present invention to provide the above connection compensating device of multiangular wrench socket, which is compatible with both metric system and British system multiangular wrenches.

According to the above objects, the connection compensating device of multiangular wrench socket of the present invention includes a main body and a connecting section. The main body is a cylindrical body. The outer circumference of the main body between two ends thereof is formed with several radially arranged flutes which extend along a circular axis by a certain length. The flutes have different cross-sectional areas. The connecting section includes a first tubular body fitted around the main body. The first tubular body is rotatable about the circular axis of the main body. The first tubular body is partially overlaid on the flutes. The geometric central axis of the profile of inner circumference of the first tubular body does not coincide with the circular axis of the main body.

The present invention can be best understood through the following description and accompanying drawings wherein:

DETAILED DESCRIPTION OF THE PREFERRED EMBODIMENTS

Figure 1:
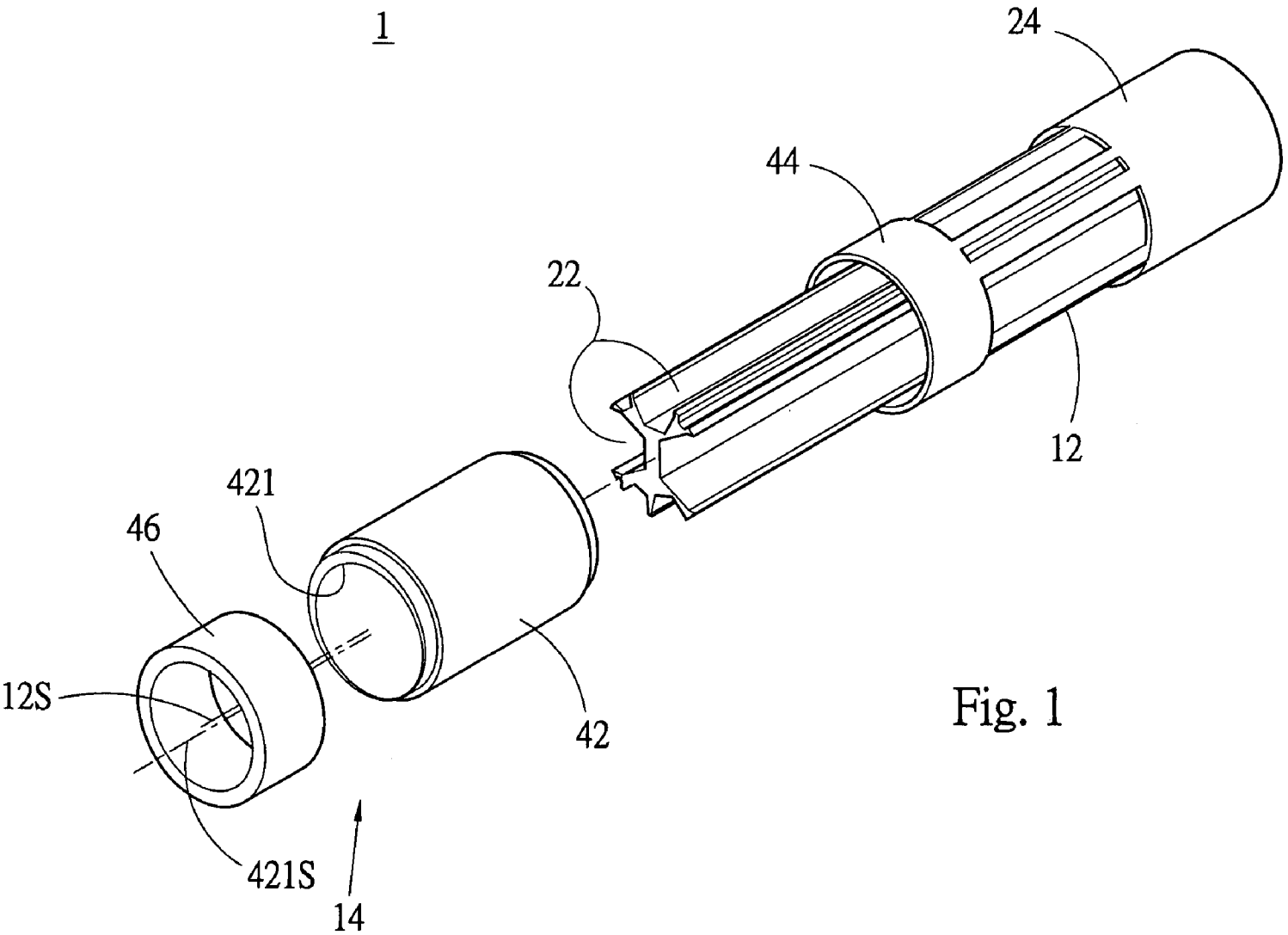
FIG. 1 is a perspective exploded view of a first embodiment of the present invention.
Figure 2:
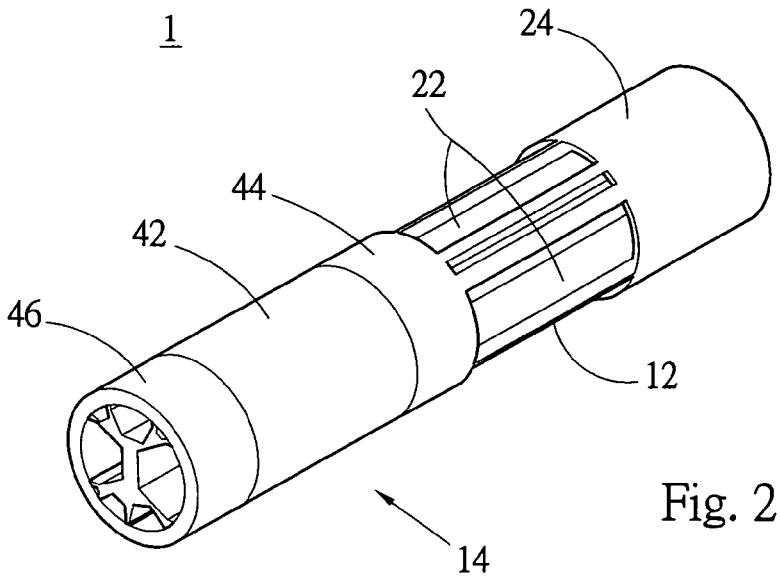
FIG. 2 is a perspective assembled view of the first embodiment of the present invention.

Please refer to FIGS. 1 and 2. The connection compensating device 1 of multiangular wrench socket of present invention includes a main body 12 and a connecting section 14.

The main body 12 is a cylindrical body. The outer circumference of the main body 12 between two ends thereof is formed with several radially arranged flutes 22 which extend along the circular axis 12S by a certain length. The flutes 22 have different cross-sectional areas.

The connecting section 14 includes a first tubular body 42 fitted around the main body 12. The first tubular body 42 is rotatable about the circular axis 12S of the main body 12. The first tubular body 42 is partially overlaid on the flutes 22. The geometric central axis 421S of the profile of the inner circumference 421 of the first tubular body 42 does not coincide with the circular axis 12S of the main body 12. Accordingly, when rotating the first tubular body 42, the geometric central axis 421S of the profile of the inner circumference 421 of the first tubular body 42 is rotated about the circular axis of the main body 12.

The connecting section 14 further includes a second tubular body 44 and a third tubular body 46. The second and third tubular bodies 44, 46 are fixedly fitted on the main body 12 and respectively positioned at two ends of the first tubular body 42. The two ends of the first tubular body 42 are respectively pivotally fitted with one end of the second tubular body 44 and one end of the third tubular body 46. When rotating the first tubular body 42, the geometric central axis 421S of the profile of the inner circumference 421 of the first tubular body 42 is rotated about the circular axis of the main body 12.

Figure 3:
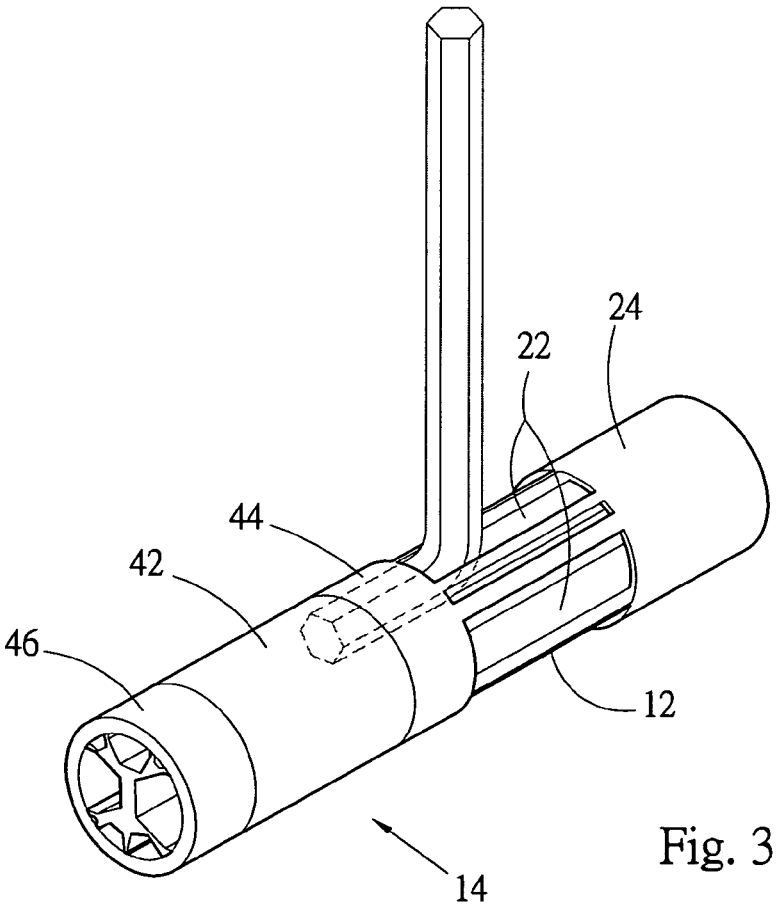
FIG. 3 is a perspective view of the first embodiment of the present invention, which is assembled with a hexagonal wrench.
Figure 4:
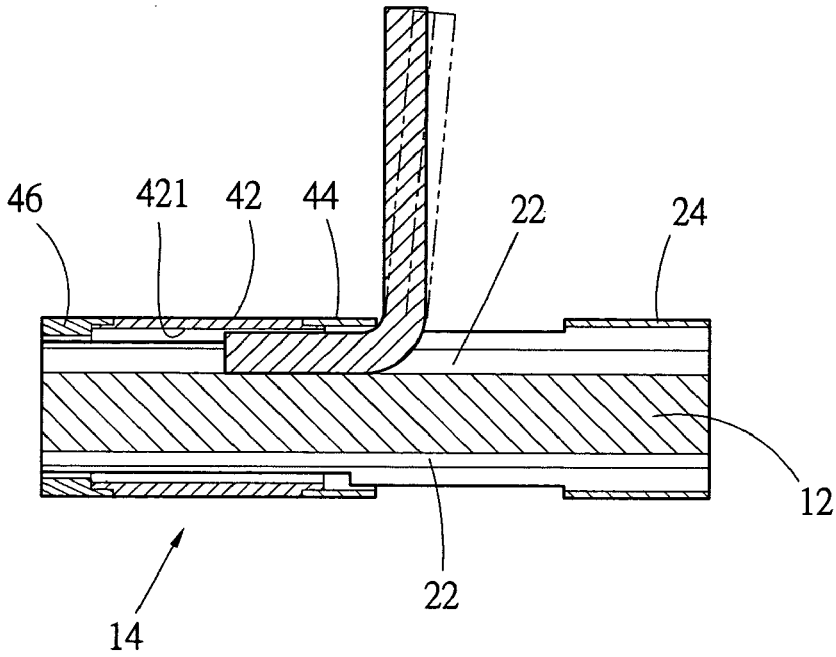
FIG. 4 is an axially sectional view according to FIG. 3, in which the hexagonal wrench is not yet fastened.
Figure 5:
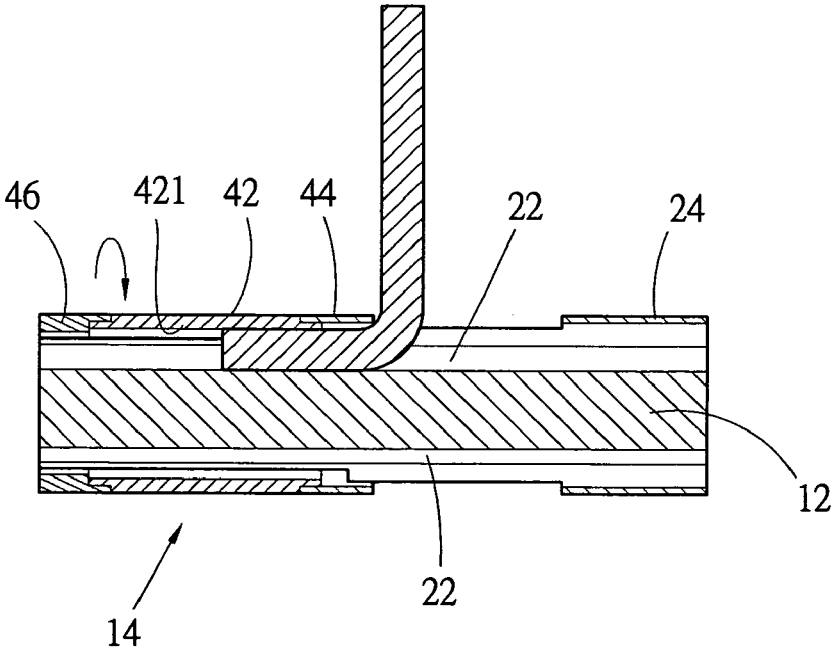
FIG. 5 is an axially sectional view according to FIG. 3, in which the hexagonal wrench is fastened.
Figure 6:
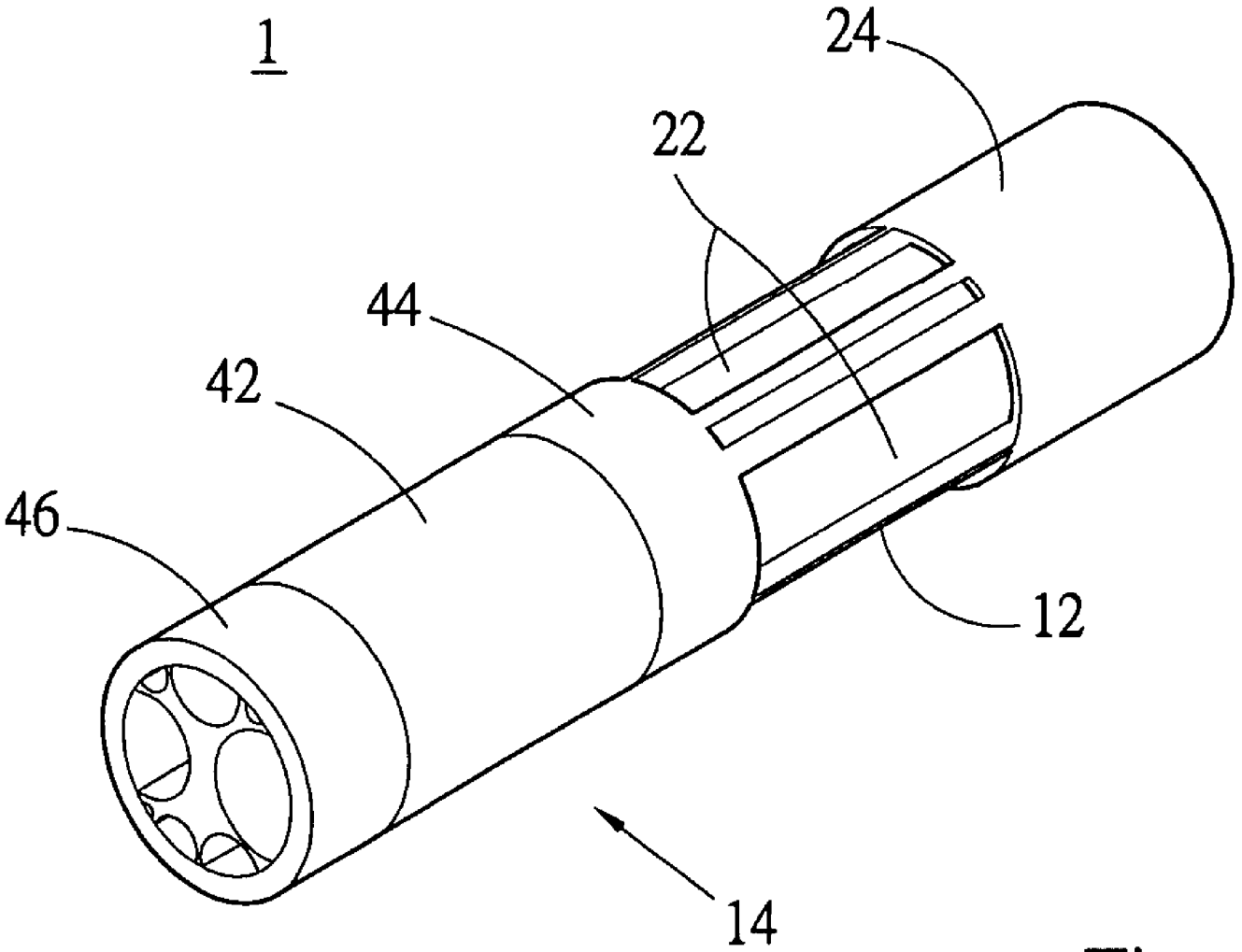
FIG. 6 is a perspective assembled view of a second embodiment of the present invention.
Figure 7:
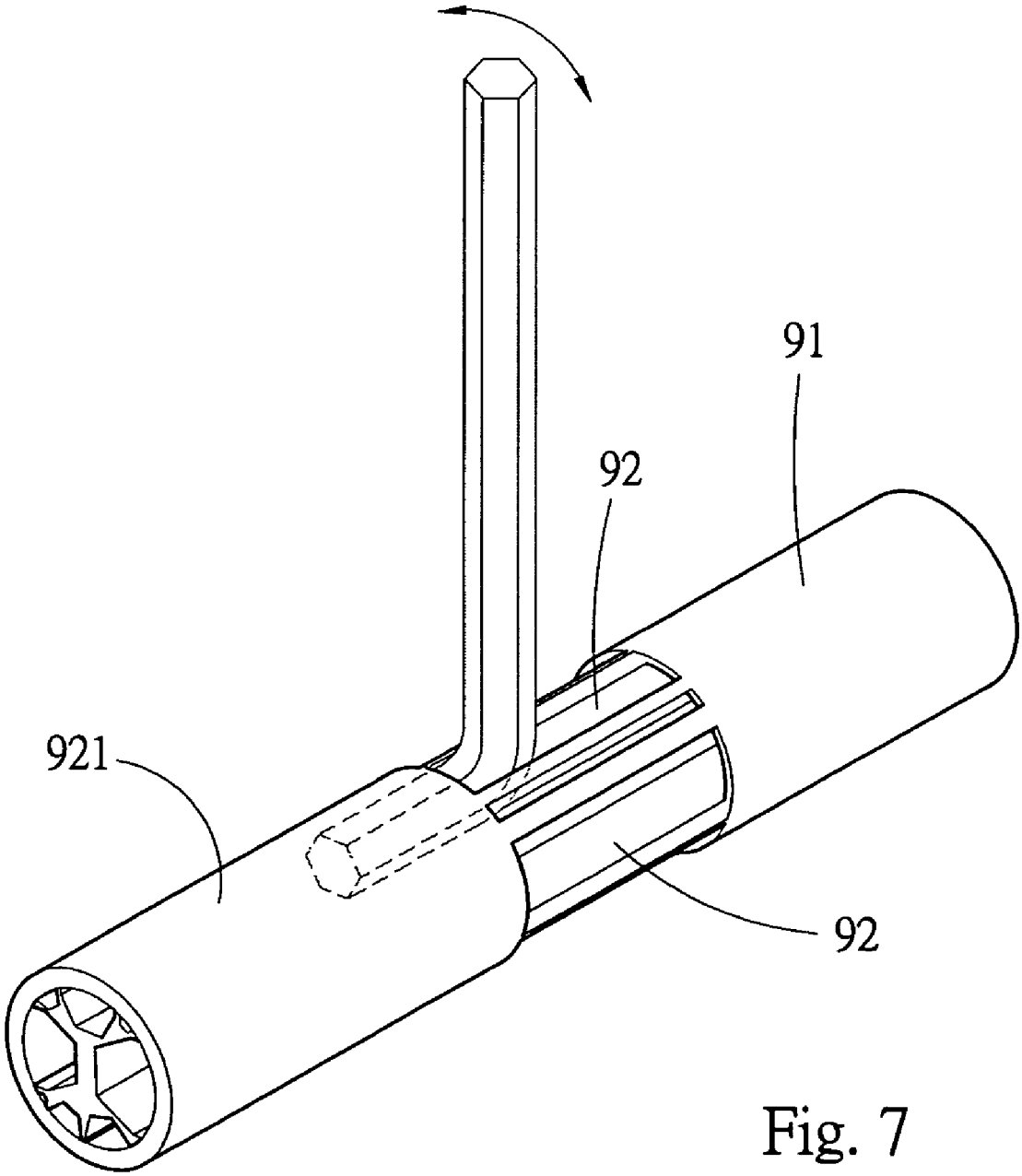
Fig. 7 Prior Art
FIG. 7 is a perspective view of a conventional socket structure of hexagonal wrench.

Referring to FIGS. 3 to 5, a user can insert a short bar section of an L-shaped hexagonal wrench from one side of the main body 12 into a suitable flute 22 and the first tubular body 42 of the connecting section 14. At this time, a gap exists between the inner circumference 421 of the first tubular body 42 and the hexagonal wrench. However, the geometric central axis 421S of the profile of the inner circumference 421 of the first tubular body 42 does not coincide with the circular axis 12S of the main body 12. Therefore, the user can rotate the first tubular body 42, whereby the inner circumference 421 of the first tubular body 42 will compensate the gap and tightly abut against the hexagonal wrench.

According to the above arrangement, the connection compensating device 1 of multiangular wrench socket of the present invention has the following advantages:

1. The present invention can be firmly connected with a multiangular wrench and conveniently operated. For example, the present invention is applicable to a socket wrench.
2. The present invention is compatible with both metric system and British system multiangular wrenches.

The flutes 22 have openings at at least one end of the main body 12. A fourth tubular body 24 is fixedly fitted on the end of the main body 12. The long bar sections of several multiangular wrenches can be inserted into the openings of the flutes 22 and collectively stored.

In the above embodiment, each flute 22 has a polygonal cross-section.

Alternatively, in the above embodiment, each flute 22 has a pentagonal cross-section.

Still alternatively, in the above embodiment, each flute 22 has an arched cross-section.

The above embodiments are only used to illustrate the present invention, not intended to limit the scope thereof. Many modifications of the above embodiments can be made without departing from the spirit of the present invention.

What is claimed is:

1. A connection compensating device of multiangular wrench socket, comprising:

a main body which is a cylindrical body, outer circumference of the main body between two ends thereof being formed with several radially arranged flutes which extend along a circular axis of the main body by a certain length, the flutes having different cross-sectional areas; and a connecting section including a first tubular body fitted around the main body, the first tubular body being rotatable about the circular axis of the main body, the first tubular body being partially overlaid on the flutes, a geometric central axis of the profile of inner circumference of the first tubular body being not coincided with the circular axis of the main body.

2. The connection compensating device of multiangular wrench socket as claimed in claim 1, wherein the connecting section further includes a third and a fourth tubular bodies, the second and third tubular bodies being fixedly fitted on the main body and respectively positioned at two ends of the first tubular body, the two ends of the first tubular body being respectively pivotally fitted with one end of the second tubular body and one end of the third tubular body, whereby when rotating the first tubular body, the geometric central axis of the profile of the inner circumference of the first tubular body is rotated about the circular axis of the main body.

3. The connection compensating device of multiangular wrench socket as claimed in claim 2, wherein the flutes have openings at at least one end of the main body, a fourth tubular body being fixedly fitted on the end of the main body for collectively storing several multiangular wrenches.

4. The connection compensating device of multiangular wrench socket as claimed in claim 3, wherein each flute has a polygonal cross-section.

5. The connection compensating device of multiangular wrench socket as claimed in claim 4, wherein each flute has a pentagonal cross-section.

6. The connection compensating device of multiangular wrench socket as claimed in claim 3, wherein each flute has an arched cross-section.

7. The connection compensating device of multiangular wrench socket as claimed in claim 2, wherein each flute has a polygonal cross-section.

8. The connection compensating device of multiangular wrench socket as claimed in claim 7, wherein each flute has a pentagonal cross-section.

9. The connection compensating device of multiangular wrench socket as claimed in claim 2, wherein each flute has an arched cross-section.

10. The connection compensating device of multiangular wrench socket as claimed in claim 1, wherein the flutes have openings at at least one end of the main body, a fourth tubular body being fixedly fitted on the end of the main body for collectively storing several multiangular wrenches.

11. The connection compensating device of multiangular wrench socket as claimed in claim 10, wherein each flute has a polygonal cross-section.

12. The connection compensating device of multiangular wrench socket as claimed in claim 11, wherein each flute has a pentagonal cross-section.

13. The connection compensating device of multiangular wrench socket as claimed in claim 10, wherein each flute has an arched cross-section.

14. The connection compensating device of multiangular wrench socket as claimed in claim 1, wherein each flute has a polygonal cross-section.

15. The connection compensating device of multiangular wrench socket as claimed in claim 14, wherein each flute has a pentagonal cross-section.

16. The connection compensating device of multiangular wrench socket as claimed in claim 1, wherein each flute has an arched cross-section.

* * * * *